United States Patent [19]

Atherton

[11] 4,120,501

[45] Oct. 17, 1978

[54] INCLINED TRACK BALL AND DICE GAME

[76] Inventor: Roger Lee Atherton, 5328 Larkspur St., Ventura, Calif. 93001

[21] Appl. No.: 837,928

[22] Filed: Sep. 29, 1977

[51] Int. Cl.[2] ..... A63F 7/02

[52] U.S. Cl. ..... 273/120 R; 273/86 C

[58] Field of Search ..... 273/86 C, 120 R, 120 A, 273/86 A, 118 R, 112; 46/43

[56] References Cited

U.S. PATENT DOCUMENTS

| | | | |
|---|---|---|---|
| 503,022 | 8/1893 | Whitburn | 273/120 R |
| 1,776,640 | 9/1930 | Simmons | 273/86 C |
| 3,206,209 | 9/1965 | Farrah | 273/120 R |
| 3,589,724 | 6/1971 | Barlow | 273/1 R |
| 3,703,989 | 11/1972 | Tomiyama | 46/43 |
| 3,768,810 | 10/1973 | Goldfarb et al. | 273/120 R |
| 4,007,933 | 2/1977 | Cooper | 273/86 C |
| 4,094,508 | 6/1978 | Krisch | 273/118 R |

*Primary Examiner*—Richard C. Pinkham

*Assistant Examiner*—Lawrence E. Anderson

*Attorney, Agent, or Firm*—Ralph B. Pastoriza

[57] ABSTRACT

The game comprises first and second inclined tracks upon which balls may be placed by a player and released to roll down the tracks by gravity. Numbers on a pair of dice determine the levels at which the balls are respectively initially released. The lower ends of the tracks extend towards each other along upwardly sloped path portions to meet at a common point. The object of the game is for the player to release first the higher level ball and then after a given time interval the other ball, the player evaluating the time interval in such a manner as to cause the balls to meet at the referred to highest point of the sloped path portions to rebound from each other back onto their respective inclined tracks. If one or the other of the balls arrives at the high point of the sloped surfaces first, it will continue on over and the player will lose a point.

6 Claims, 4 Drawing Figures

P1 > P2
2d > D > d
D1 ≥ D2

INCLINED TRACK BALL AND DICE GAME

This invention relates generally to games and more particularly to a skill game involving the rolling of balls down inclined tracks.

BACKGROUND OF THE INVENTION

Skill games involving balls rolling along tracks such as spiral tracks are known in the art but generally take the form of a track structure in an enclosure with a small ball on the track, the player attempting to tilt the enclosure in such a manner as to cause the ball to reach a given position.

Other type track and ball games include a pair of tracks upon which balls are respectively caused to roll down in the manner of a race.

BRIEF DESCRIPTION OF THE PRESENT INVENTION

With the foregoing in mind, the present invention contemplates an improved inclined track and ball game wherein the same is distinguished from prior art structures by the additional provision of a pair of dice determining levels on the tracks at which the balls are initially released. Moreover, the lower end portions of the tracks extend towards each other along upwardly sloped path portions to meet at a common point at the highest point of the path portions.

With the foregoing arrangements, two balls may be placed at various levels of the tracks respectively determined by numbers showing on the dice and released in succession, the higher level ball being released first and the other ball being released a given time interval thereafter. The object is to evaluate the time interval such that the two balls will meet at the highest point of the sloped path portions and rebound back onto their respective tracks.

BRIEF DESCRIPTION OF THE DRAWINGS

A better understanding of this invention will be had by now referring to the accompanying drawings illustrating a preferred embodiment thereof wherein.

DETAILED DESCRIPTION OF THE INVENTION

Figure 1:
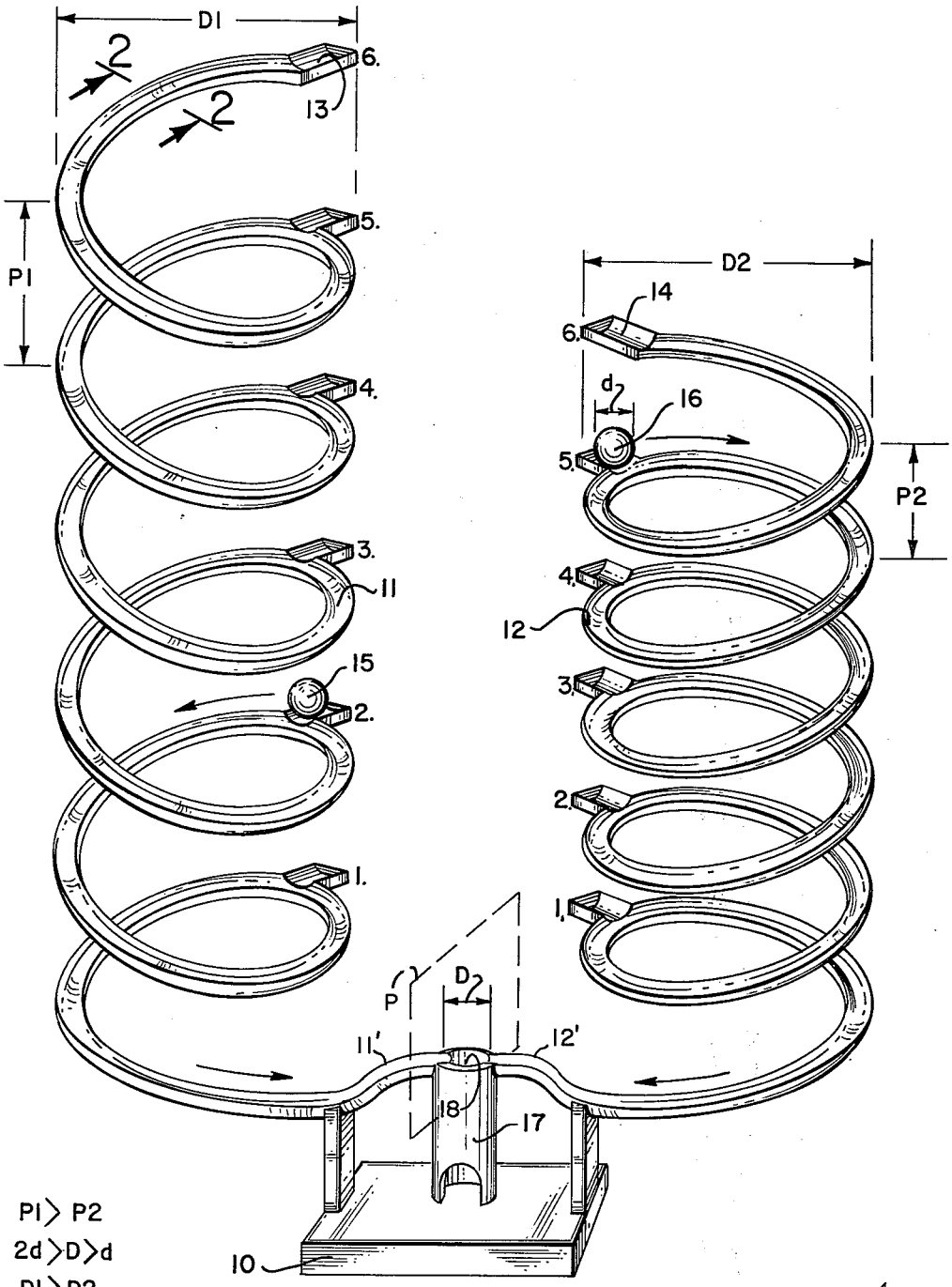
FIG. 1 is a perspective view of the basic track structure of the game of this invention showing balls in initial positions on the tracks.

Referring first to FIG. 1, the game includes a frame structure supported on a base 10 defining first and second inclined tracks 11 and 12. In the preferred embodiment, these tracks are helical and in spaced positions from each other. The lower ends of the tracks extend towards each other along upwardly sloped path portions 11′ and 12′ to meet at a common point at the highest point of the path portions. This point lies at the intersection point of the tracks with a plane P indicated by dashed lines and is below the levels of the lowest helical turns of the tracks.

Each of the tracks includes a laterally extending supporting platform at various levels which in the embodiment disclosed correspond to the respective turns of each of the helical tracks. Thus, the uppermost of these platforms are illustrated at 13 for the track 11 and at 14 for the track 12.

Various levels of the tracks are numbered 1 through 6, the number 1 designating the lowest of these levels which corresponds to the turns of each helical track. For ease of illustration, the numbers 1 through 6 are shown adjacent to the corresponding supporting platforms but it will be understood these numbers would be marked directly on the platforms.

Also illustrated in FIG. 1 are two balls 15 and 16 shown positioned at different levels of the first and second helical tracks 11 and 12. For example, the ball 15 is shown positioned on the platform associated with the number 2; that is, the second helical turn up from the last turn of the helical track 11. The ball 16, on the other hand, is shown positioned on the level 5 corresponding to the next to last helical turn in an upward direction.

In the particular embodiment illustrated in FIG. 1, there is provided a receptacle 17 having an upper inlet opening 18 at the highest point of the sloped path portions 11′ and 12′. The diameter of this opening is indicated at D and is greater than the diameter of either one of the balls 15 or 16, this latter diameter being designated *d*. Further, the diameter D of the opening 18 is less than the sum of the diameters of the balls 15 and 16; that is, less than 2*d*.

Figure 2:
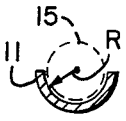
FIG. 2 is a cross section of one of the tracks taken in the direction of the arrows 2—2 of FIG. 1.

Referring to the cross section of FIG. 2, it will be noted that the track is semi-circular shaped in cross section with a radius R corresponding to that of the balls such as the ball 15 indicated in dashed lines in FIG. 2. It will be understood that any appropriate supporting track structure could be provided which will permit the ball to roll down the track by gravity and be retained in the track during this movement.

Figure 3:
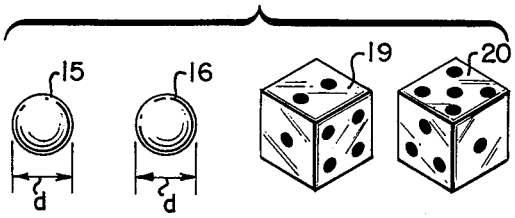
FIG. 3 is a perspective view of the balls and a pair of dice used in playing the game; and, FIG. 4 is a fragmentary perspective view of an alternative structure for the lower end portions of the tracks of FIG. 1.

FIG. 3 illustrates the balls 15 and 16 together with a pair of dice 19 and 20 utilized in playing the game.

Figure 4:
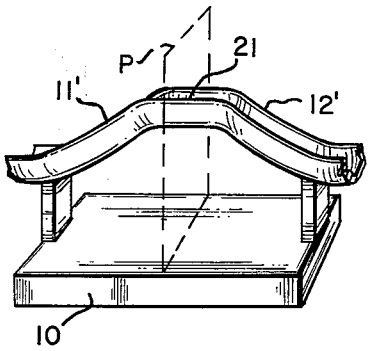

FIG. 4 shows a modification which could be provided in place of the receptacle 17 with the opening 18. Thus, the upwardly sloping path portions 11′ and 12′ of the lower ends of the tracks for each of the helical tracks 11 and 12 of FIG. 1 would simply be directly connected together as by the small track portion 21 at the highest point intersecting the plane P.

Referring back once again to FIG. 1, in the preferred embodiment shown, each of the helical tracks have six helical turns numbered 1 through 6 as described. The pitch P1 of the first helical track is different from the pitch P2 of the second helical track. As a result, the times for the balls to roll down the tracks when released at the same level will be different. In the structure shown of FIG. 1, the pitch P1 is greater than the pitch P2 so that the various platforms of the helical track 11 are at correspondingly higher levels than the platforms for the helical track 12.

In addition, the diameters of the helical tracks designated D1 and D2 respectively for the tracks 11 and 12 may be different, thereby again causing the time for the balls to roll down when released from similar levels to be different. For example, the diameter D1 may be equal to or greater than the diameter D2.

OPERATION

The game may be played by one or more persons. Thus, for example, if two people were playing the game, a first player would throw the dice 19 and 20 of FIG. 3. The numbers turned up by the dice would then determine the particular levels of the first and second helical tracks on which the balls 15 and 16 are initially placed. In the example shown in FIGS. 1 and 3, the dice show the numbers 2 and 5 and accordingly the player will place the ball 15 on platform No. 2 corresponding to the numbered helical turn 2 and the ball 16 on the platform 5 corresponding to the helical turn 5 of the second track. The dice may be of different colors corresponding to different colors for the helical tracks so that one die will be associated with one track and one die with the other. The player will thus know the proper levels of the respective tracks on which to place the ball. Alternatively, the player may have an option to select which helical track is to be associated with which die. In either event, the player will then nudge the higher level ball off of the corresponding platform onto the track to start the ball rolling down the track and will then wait a given time interval before nudging the other of the balls. The skill and object of the game is for the player to evaluate the given time interval after release of one ball at the end of which the other ball is released in such a manner that the two balls will meet at the highest point of the sloped paths 11' and 12'; that is, at the point the tracks intersect the plane P.

In the embodiment of FIG. 1, if the balls meet at the plane P, they will rebound from each other to fall back onto the lowest points of the respective helical tracks. On the other hand, should one of the balls arrive at the point defined by the plane P first, it will drop into the opening 18.

In the event the structure of FIG. 4 is employed, if the balls do not arrive at the point defined by the plane P at the same time, one of the balls will overshoot the point and both balls will be on either one side or the other of this point.

In either of the foregoing events, the player did not evaluate the given time interval properly to cause the balls to meet at the point P and rebound respectively onto their tracks and thus he will loose this point.

A second player will then throw the dice and attempt to cause the balls to meet at the point defined by the plane P so that they will rebound back onto the tracks and if he should fail, he will loose a point, whereas on the other hand if he succeeds, he gains a point.

The players can alternate and even three or more players could play each keeping his score and taking a play in turn.

It will be appreciated that because of the different pitches of the helical tracks as well as possible differences in the diameters, a great amount of skill is involved in evaluating the proper time interval before release of the lower ball after releasing the upper ball. The game structure thus provides a fascinating dynamic display during each turn of play which is not only amusing but instructive in general physical dynamics.

The provision of the platforms, while not essential, eases the release of the balls, the same simply being nudged from the platform onto the track. There is thus prevented any initial velocity being imparted to the ball by the player when releasing the ball.

From all of the foregoing, it will be evident that the present invention has provided an improved inclined track and ball game utilizing dice such that both skill and chance are involved.

I clam:

1. An inclined track ball and dice game including, in combination:

(a) a frame structure defining first and second inclined tracks disposed in spaced positions and each having numbered levels, means on each level defining a numbered starting position, the lowest ends of said tracks extending towards each other along upwardly sloped path portions to meet at a common point at the highest point of said path portions, said point being below the levels of the lowest numbered levels of said tracks;

(b) a pair of dice, (c) two balls dimensioned to be supported by said tracks respectively so that when placed at a starting position corresponding to a number on said dice and released, they will roll down the tracks by gravity;

whereby a person can throw the dice and thereafter position said balls on specifically numbered levels of the tracks determined by the numbers showing on the dice, respectively, the person then releasing the highest level ball and after a given time interval the other ball, said person attempting to evaluate said given time interval so that said balls will meet at said highest point of said sloped path portions and rebound back to come to rest at the lowest points of the inclined tracks upon which they were respectively initially positioned.

2. A game according to claim 1, in which each numbered level of each of said tracks includes a laterally extending starting position so that in placing and releasing balls on various ones of said levels, they can be placed on the corresponding positions and then nudged onto the track to start them rolling down the track.

3. A game according to claim 1, in which there is provided a receptable having an upper inlet opening at said highest point of said sloped path portions of diameter greater than the diameter of either one of said balls and less than the sum of the diameters of said balls so that should one of the balls arrive at said highest point before the other, it will drop into said receptacle.

4. A game according to claim 1, in which said first and second inclined tracks are respectively helical, each helical turn of each of said tracks being numbered to define said numbered levels.

5. A game according to claim 4, in which said first and second tracks each have six helical turns numbered 1 through 6, the pitch of the first helical track being different from the pitch of the second helical track so that the times for the balls to roll down the tracks when released at the same level are different.

6. A game according to claim 4, in which said first and second tracks each has six helical turns numbered 1 through 6, the diameters of said helical turns being different from each other so that the times for the balls to roll down the tracks when released at the same level are different.

* * * * *